United States Patent [19]

Ackerman

[11] Patent Number: 4,653,559

[45] Date of Patent: Mar. 31, 1987

[54] FORWARDLY-PROJECTING DEBARKING TOOL BARKER ARM

[75] Inventor: Robert T. Ackerman, Seattle, Wash.

[73] Assignee: Nicholson Manufacturing Company, Seattle, Wash.

[21] Appl. No.: 713,979

[22] Filed: Mar. 20, 1985

[51] Int. Cl.[4] ..... B27L 1/00

[52] U.S. Cl. ..... 144/208 E; 144/241; 144/340

[58] Field of Search ..... 144/208 R, 208 E, 340, 144/241

[56] References Cited

U.S. PATENT DOCUMENTS

| | | | |
|---|---|---|---|
| 2,880,771 | 4/1959 | Annis, Jr. | 144/208 E |
| 4,280,541 | 7/1981 | Reimler | 144/208 E |
| 4,425,951 | 1/1984 | Poosette et al. | 144/208 E |

FOREIGN PATENT DOCUMENTS

| | | | |
|---|---|---|---|
| 786124 | 5/1968 | Canada | 144/208 E |

*Primary Examiner*—W. D. Bray

*Attorney, Agent, or Firm*—Robert W. Beach; Ward Brown

[57] ABSTRACT

The scraping edge of a debarking tool carried by an arm of a rotary ring barker is located lengthwise so that at least the major portion of the length of such scraping edge is located ahead of the longitudinally central portion of the leading face of the barker arm, and the leading edge of the debarking tool remote from the rotary ring is beveled by being inclined from the leading face of the debarking tool forward away from the barker ring.

8 Claims, 15 Drawing Figures

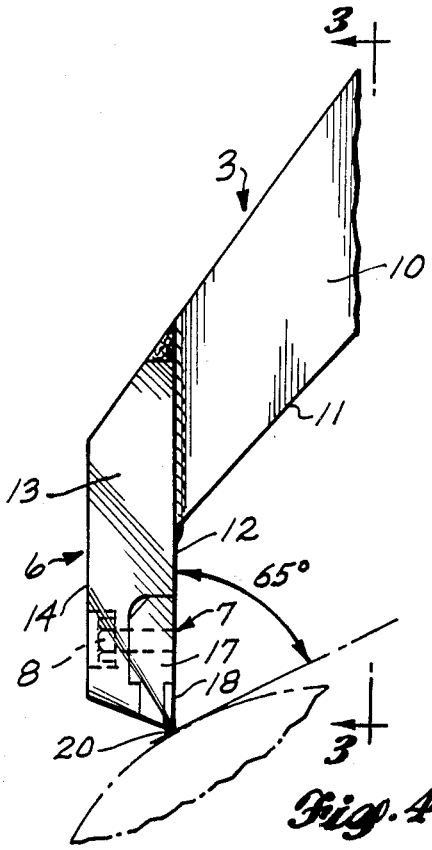
Fig. 4
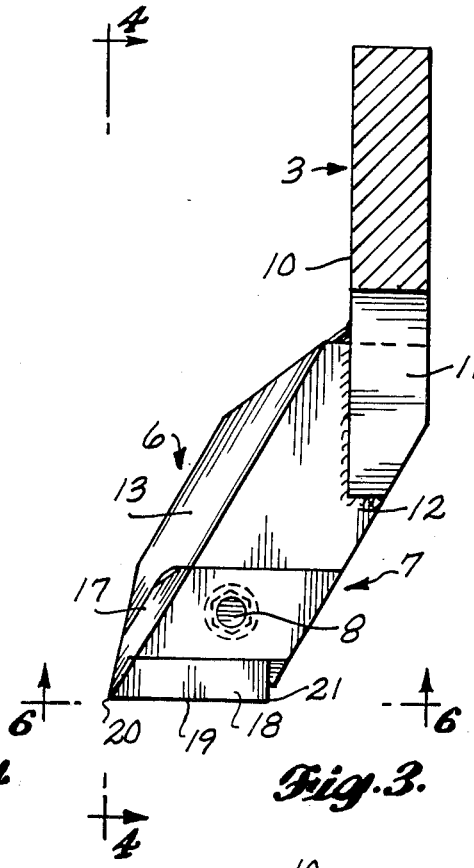
Fig. 3.
Fig. 5.
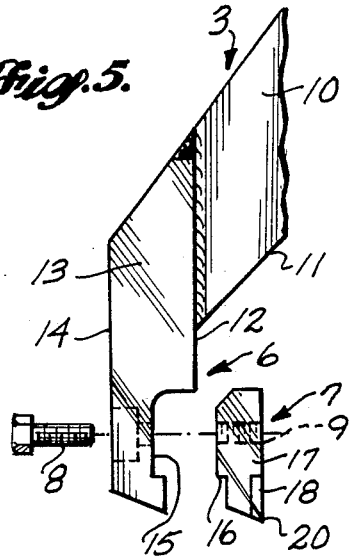
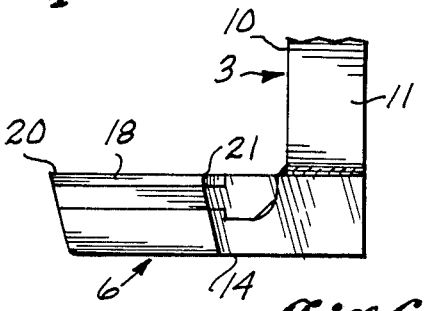
Fig. 6.
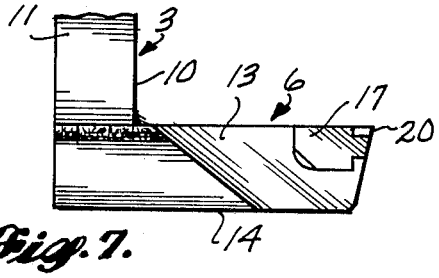
Fig. 7.

FORWARDLY-PROJECTING DEBARKING TOOL BARKER ARM

BACKGROUND OF THE INVENTION

1. Field of the Invention

This invention relates to an arm for rotary ring log barkers and, more particularly, to such an arm having a forwardly-projecting debarking tool.

2. Prior Art

Rotary ring barkers are conventional and include a ring carrying swingable arms having tips engageable with a log moved lengthwise through the aperture of the ring for scraping the bark from the log.

3. The Problem

Difficulty has been experienced with rotary ring log barkers used heretofore in removing bark from logs having fibrous or stringy bark such as cedar, redwood and eucalyptus. Special tools have been used for removing such bark, but they have not solved the problem adequately.

SUMMARY OF THE INVENTION

It is an object of the present invention to provide a barker arm which will remove fibrous or stringy bark effectively to leave a clean log surface.

More specifically, it is an object to provide a barker arm carrying a debarking tool to form an assembly that will scavenge effectively bark sheared from a log to prevent such bark from accumulating between the log and the barker arm to wedge the barker arm outward so as to lift the debarking tool out of contact with the log.

A further object is to provide a barker arm having a debarking tool that will remove fibrous or stringy bark efficiently so that a log can be fed through the rotary barker ring at high speed.

The foregoing objects can be accomplished by providing a debarking tool carried by the swinging end of a barker arm and having a scraping edge that is offset forward from the major portion of the shank of the barker arm so as to provide a pointed projecting toe initially engageable with the bark on a log being debarked and which tool has a beveled leading edge that acts to roll the bark sheared from the log away from the arm shank and barker ring.

BRIEF DESCRIPTION OF THE DRAWINGS

FIG. 3 is a section through the tip portion of a barker arm taken on line 3—3 of FIG. 4, and FIG. 4 is an elevation of the tip portion of a barker arm viewed from the line 4—4 of FIG. 3.

FIG. 5 is a view similar to FIG. 4 but showing parts in exploded relationship.

FIG. 6 is a bottom plan of the tip portion of a barker arm viewed from line 6—6 in FIG. 3.

FIG. 7 is a top plan of the tip portion of a barker arm viewed from line 7—7 in FIG. 8.

DETAILED DESCRIPTION

Figure 1:
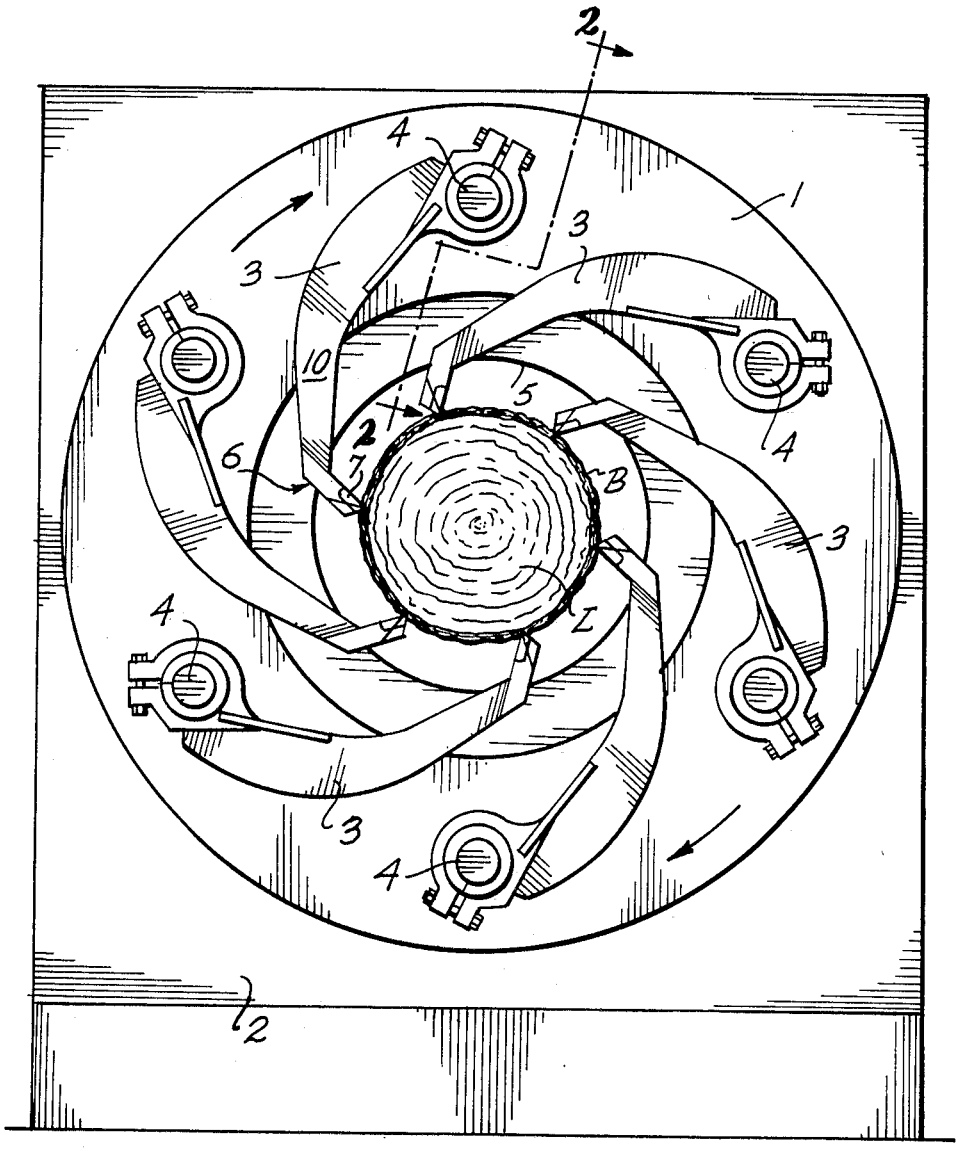
FIG. 1 is a front elevation of a rotary ring barker shown diagrammatically.

A conventional ring type of log barker includes a rotary ring 1 rotatively mounted in a frame 2 and carrying a plurality of barker arms 3, such as five or six arms, mounted on journals 4 for swinging relative to the barker ring. Such ring has a central aperture 5 through which a log L can be fed lengthwise in the direction indicated by the arrow in FIG. 2 toward the leading sides of the rotary ring and the barker arms and away from the trailing sides of the rotary ring and barker arms for removing bark B from the log.

Figure 9:
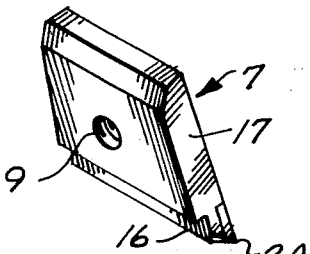
FIG. 9 is a top perspective of a debarking tool knife.

The bark-removing operation is effected by the debarking tools 6 mounted on the swinging ends of the barker arms. The debarking operation actually is effected by knives 7 constituting the end portions of the debarking tools which can be removed at will to be replaced when worn. Each knife can be secured on the debarking tool by a machine screw 8 extending through an aperture in the debarking tool and screwed into a tapped hole 9 in the knife as shown in FIGS. 5 and 9.

Figure 2:
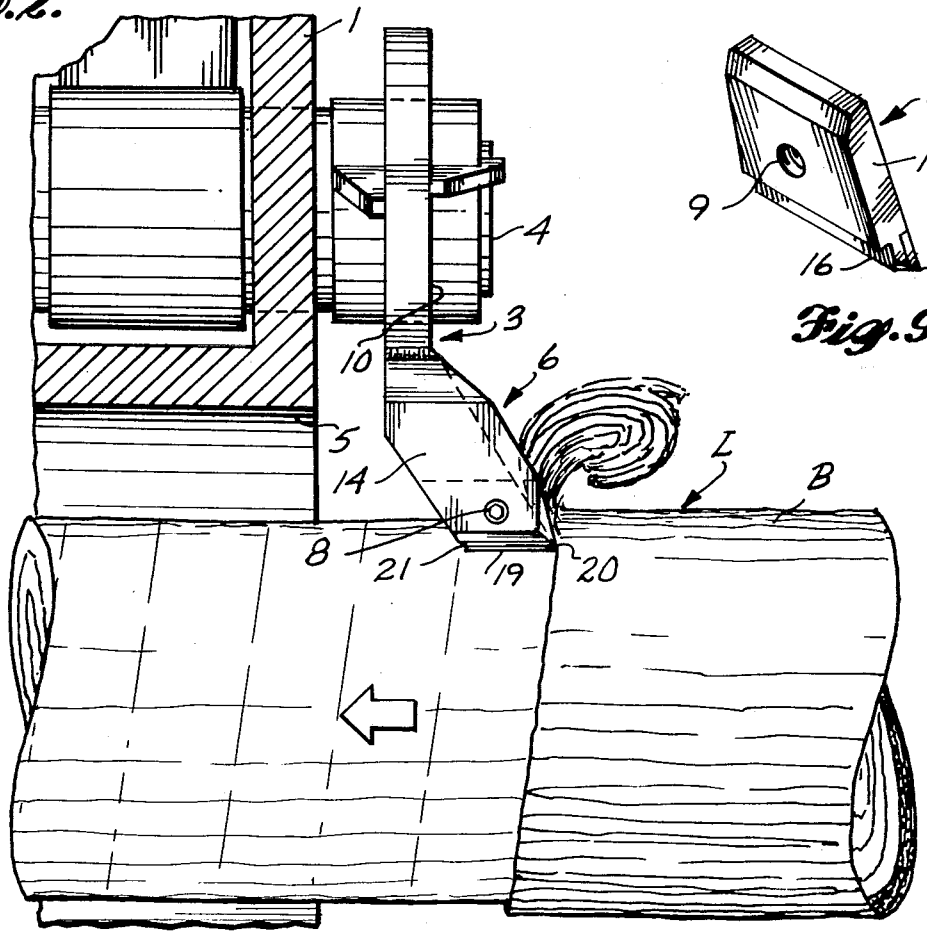
FIG. 2 is a fragmentary radial section through the barking ring taken on line 2—2 of FIG. 1.

The barker arm has a leading face 10 that, as shown in FIG. 2, faces toward a log L to be debarked fed lengthwise toward the rotary ring 1 in the direction indicated by the arrow in FIG. 2. Such leading face of the barker arm also faces away from the ring 1 on which it is mounted. The barker arm has an inner edge 11 that is inclined generally toward the log, is closer to the log and is the front edge of the arm as the ring rotates around the log in a clockwise direction as seen in FIG. 1 looking in the direction in which the log to be debarked moves into and through the barker ring.

The debarking tool 6 has a face 12 that constitutes the front face of the debarking tool as the barker arm 3 is moved clockwise around the log. As shown in FIG. 4, the front face of the debarking tool is at an obtuse angle within the range of 140 degrees to 160 degrees relative to the inner or front edge 11 of the barker arm. Such angle enables the debarking tool to assume a raking angle with respect to the surface of the log L being debarked. The raking angle between the front face 12 of the debarking tool and a tangent to the point of contact of the debarking knife with the log should usually be within the range of 60 degrees to 70 degrees, perhaps averaging 65 degrees as indicated in FIG. 4.

The debarking tool 6 has a beveled leading edge 13 facing generally toward a log being fed to the barker and generally away from the barker ring 1. Such leading edge is inclined from the front face of the debarking tool away from the barker ring and toward a log being fed to the barker ring. Stated in another way, the included angle between the knife front face 12 and such leading edge 13 is obtuse. The debarking tool also has a rear face 14 opposite the front face 12 of the tool with respect to the direction in which the debarking tool is drawn around a log being debarked.

As stated above, the debarking knife 7 is a detachable part of the debarking tool held in place by the single machine screw 8. The knife 7 fits a recess in the end portion of the debarking tool 6 so that reliance is not be placed on the machine screw 8 to prevent turning of the debarking knife relative to the debarking tool about the axis of the machine screw 8. To prevent such turning, the tip of the debarking tool has in it an elongated groove 15 shaped substantially complementally to the debarking knife which has a shoulder 16 arranged to fit into the groove of the debarking tool for interengagement.

The debarking knife has a leading end 17 which, as shown in FIG. 3, is faired into the beveled leading edge 13 of the debarking tool.

Preferably, the debarking knife has a tungsten carbide insert 18 in its portion engageable with the surface of the log L which insert has an acute-angled edge forming the log-contacting corner or scraping edge 19. The leading end of this tungsten carbide insert forms the toe 20 of the debarking tool and the opposite trailing end of the inset forms the debarking tool heel 21.

Figure 8:
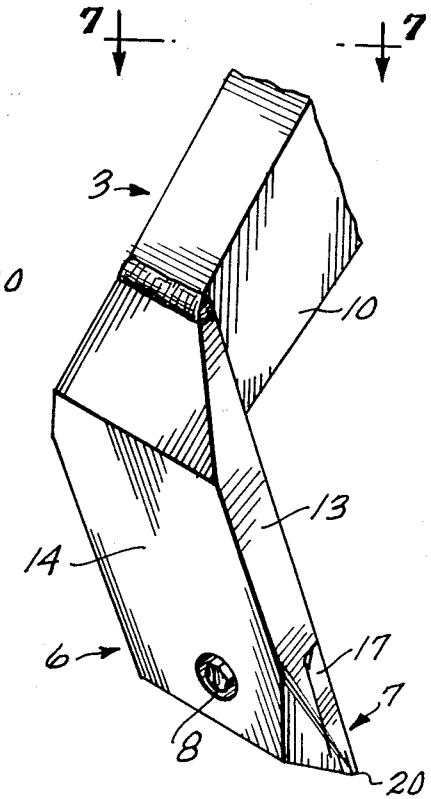
FIG. 8 is a top perspective of the tip portion of a barker arm.

As shown best in FIGS. 3, 6 and 8, the leading edge 13 of the debarking tool is beveled relative to the front face 12 of such tool at an obtuse angle of 120 to 160 degrees, preferably about 135 or 140 degrees, so as to constitute a deflecting surface for stringy bark B sheared from the surface of the log by the scraping edge 19, front face and toe 20 of the debarking knife inset 18.

Conventional debarking tools are substantially coplanar with the debarking arms carrying them. On the contrary, the debarking tool 6 of the present barker arm is inclined forward toward an approaching log and inward toward the log from the swinging end of the arm 3, as shown in FIGS. 2, 3, 4 and 8. The reentrant angle between the leading face 10 of the barker arm and the leading edge 13 of the debarking tool is in the range of 140 degrees to 160 degrees, preferably about 150 degrees, and the length of the debarking tool is such that at least the major portion of the length of the scraping edge 19, and preferably the entire scraping edge, is located forwardly toward an approaching log from the leading face 10 of the barker arm.

Such forward projection of the debarking tool scraping edge 19 from the barker arm may be accomplished without providing a reentrant portion between the leading face of the barker arm and the leading edge of the debarking tool by inclining the entire barker arm forward toward an approaching log but, in that case, the scraping edge 19 should still be located so that the major portion of its length is forward of the major portion of the length of the leading face of the barker arm.

The reason for locating the scraping edge of the debarking tool so that at least a major portion of its length projects beyond the longitudinally central portion of the leading face 10 of the barker arm 3 toward a log to be debarked approaching the rotary ring is to shear the bark from the log at a location largely or entirely ahead of the barker arm. Otherwise, if the bark is stringy, rotation of the barker arm around the log tends to roll the bark into a roll or ball of a size greater than the clearance between the log and the front edge 11 of the barker arm and under such arm so that such accumulation of bark wedges the swinging end of the arm outward to lift the scraping edge 19 of the debarking tool knife away from the cambium layer of the log. Such lifting of the debarking tool causes the knife scraping edge to skip portions of at least the inner layers of the bark so that the log is not debarked cleanly. Preferably the entire scraping edge of the debarking tool projects beyond the leading face 10 of the barker arm toward a log to be debarked approaching the rotary ring as shown in FIGS. 2 and 3.

The beveled shape of the leading edge 13 of the debarking tool 6 assists in controlling scavenging of the bark B sheared from the log by guiding it to curl back toward the unbarked portion of the log without forming a tight roll or ball under the barker arm. The bark detached from the log thus tends to form successive rolls which periodically break away and fall downward at the side of the rotary ring and barker arms toward the log that is moving toward the rotary ring.

The pointed toe 20 of the debarking tool also contributes to the rolling up of the bark at the leading side of the major portion of the length of the barker arms by the pointed shape of the toe digging into the bark both to effect a spiral cleavage of the bark at the cambium layer and also to effect somewhat of a wedging action on the bark at the edge of the kerf. The result is that the barking occurs very rapidly, such as at lineal spreads of the log of 130 feet (39.6 meters) per minute and more.

Figure 10:
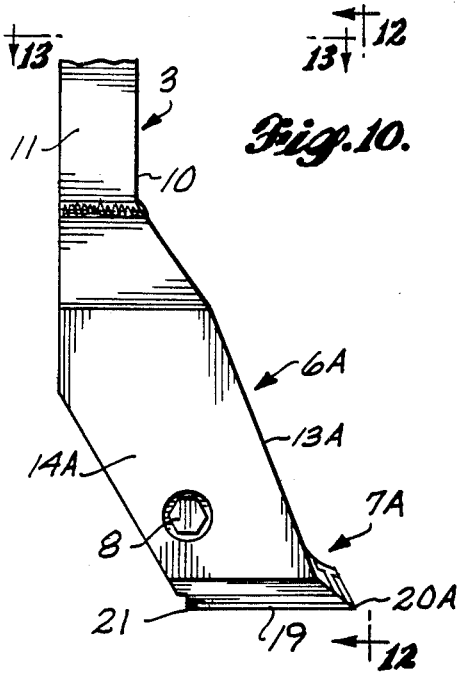
FIG. 10 is a rear elevation of the tip portion of a barker arm showing a modified type of debarking tool.
Figure 11:
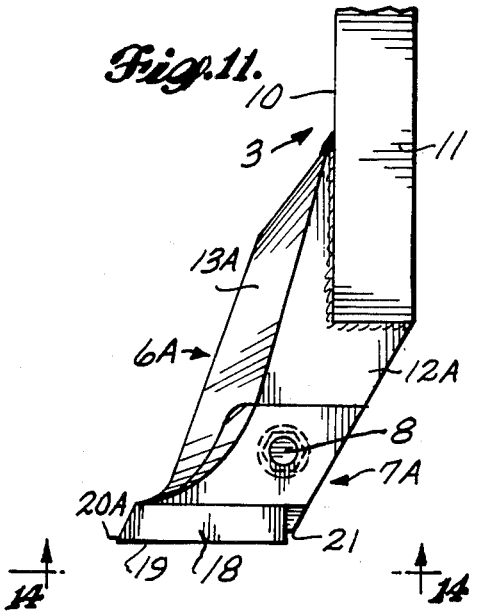
FIG. 11 is a front elevation of the tip portion portion of such an arm.
Figure 13:
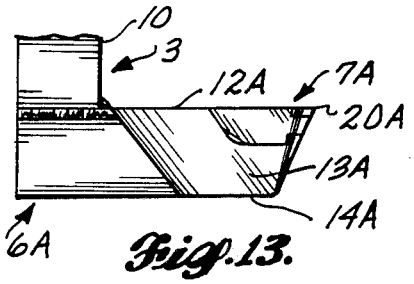
FIG. 13 is a plan of the tip portion of the modified barker arm viewed from line 13—13 in FIG. 10.
Figure 14:
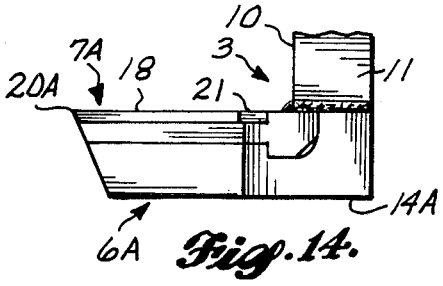
FIG. 14 is a bottom plan of such modified barker arm tip portion viewed from line 14—14 of FIG. 11.
Figure 12:
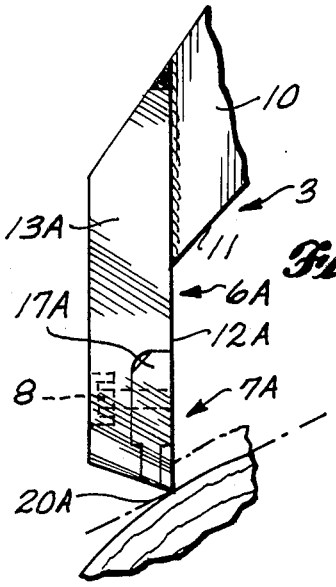
FIG. 12 is an edge elevation of the tip portion of the modified barker arm viewed from line 12—12 of FIG. 10.
Figure 15:
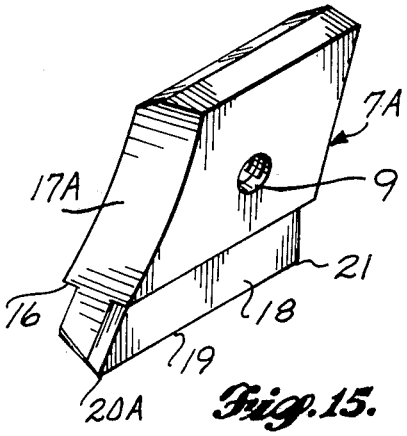
FIG. 15 is a top perspective of the knife of the modified barker arm shown in FIGS. 10 to 14.

The modified debarking tool 6A shown in FIGS. 10 to 14 differs from the debarking tool shown in FIGS. 2 to 8 by the leading edge 13A of the debarking tool not only being beveled to make an obtuse angle with respect to the debarking tool front face 12A but also by such leading edge being longitudinally concave to some extent instead of being planar. Thus the tip portion of the debarking tool and of the knife 7A are swept forward, as shown in FIGS. 10 and 11. Also the leading edge 17A of the knife 7A is concave with its tip swept forward to fair into the beveled and concave leading edge 13A of the debarking tool 6A.

The scraping edge 19 and toe 20A of the knife 7A operate in the same manner as described in connection with the operation of the debarking tool shown in FIGS. 2 to 9, but the toe 20A of the debarking tool shown in FIGS. 10 to 15 is somewhat sharper than the toe 20 of the debarking tool shown in FIGS. 2 to 9 and has a more pronounced shearing and digging action to sever the bark more cleanly along the edge of the spiral barking kerf.

I claim:

1. In a log barker, a rotary ring having a central aperture for movement of a log therethrough, a leading side toward which a log to be debarked is moved and a trailing side away from which the debarked log is moved, a barker arm swingably mounted on the rotary ring for swinging about an axis extending parallel to the axis of the rotary ring and having a leading face facing toward a log to be debarked approaching the rotary ring and a front inner edge facing in the direction the barker arm is moved by rotation of the ring and facing a log moving through the ring, and a scraping debarking tool carried by the swingable end of the barker arm, the improvement comprising the debarking tool having a scraping edge extending generally parallel to the axis of the rotary ring and which scraping edge is located lengthwise so that the major portion of the length of said scraping edge projects beyond the longitudinally central portion of the leading face of the barker arm toward a log to be debarked approaching the rotary ring.

2. In the log barker defined in claim 1, the scraping edge being located lengthwise so that its entire length projects beyond the longitudinally central portion of the leading face of the barker arm toward a log to be debarked approaching the rotary ring.

3. In the log barker defined in claim 1, the debarking tool having a leading edge facing generally toward a log to be debarked approaching the rotary ring, which debarking tool leading edge is disposed at a reentrant obtuse angle to the leading face of the barker arm.

4. In the log barker defined in claim 1, the debarking tool having a leading edge facing generally toward a log to be debarked approaching the rotary ring, and the debarking tool further having a front face facing in the direction the barker arm is moved by rotation of the ring, said debarking tool leading edge being beveled by being inclined from said front face of the debarking tool toward a log to be debarked approaching the rotary ring.

5. In the log barker defined in claim 1, the debarking tool having a leading edge facing generally toward a log to be debarked approaching the rotary ring, the leading face of the barker arm and the leading edge of the debarking tool in combination being reentrant.

6. In the log barker defined in claim 1, the debarking tool having a leading edge facing generally toward a log to be debarked approaching the rotary ring, said debarking tool leading edge being reentrant.

7. In the log barker The arm defined in claim 1, the debarking tool having a leading edge facing generally toward a log to be debarked approaching the rotary ring, said debarking tool leading edge being concave.

8. In the log barker defined in claim 1, the debarking tool having a pointed toe at the end of its scraping edge facing generally toward a log to be debarked approaching the rotary ring.

* * * * *